United States Patent [19]

Panzera et al.

[11] 3,979,273

[45] Sept. 7, 1976

[54] METHOD OF FORMING ALUMINIDE COATINGS ON NICKEL-, COBALT-, AND IRON-BASE ALLOYS

[75] Inventors: Carlino Panzera, Cromwell, Conn.; Richard Carroll Krutenat, Richland, Wash.

[73] Assignee: United Technologies Corporation, Hartford, Conn.

[22] Filed: May 27, 1975

[21] Appl. No.: 580,631

[52] U.S. Cl. ..... 204/192; 29/194; 29/196; 29/197; 427/252; 427/405; 428/336; 204/298

[51] Int. Cl.[2] ..... C23C 15/00; C23C 13/02; B23P 3/20

[58] Field of Search ..... 204/192, 181, 40, 38 S, 204/47; 427/252, 405; 428/335, 336; 29/194, 196, 197

[56] References Cited

UNITED STATES PATENTS

| | | | |
|---|---|---|---|
| 3,677,789 | 7/1972 | Bungardt et al. | 427/205 |
| 3,692,554 | 9/1972 | Bungardt et al. | 427/252 |
| 3,713,901 | 1/1973 | Blumenthal et al. | 148/6.3 |
| 3,819,338 | 6/1974 | Bungardt et al. | 29/194 |

FOREIGN PATENTS OR APPLICATIONS

| | | | |
|---|---|---|---|
| 4,749,987 | 12/1972 | Japan | 204/192 |

*Primary Examiner*—John H. Mack
*Assistant Examiner*—Aaron Weisstuch
*Attorney, Agent, or Firm*—Richard N. James; John D. Del Ponti

[57] ABSTRACT

A method of coating is described wherein a nickel-, cobalt- or iron-base alloy is provided with a oxidation and sulfidation-resistant coating by depositing, to a thickness greater than one micron but less than three microns, 90–97%, by weight, of a platinum group metal selected from the group consisting of platinum, palladium, rhodium, ruthenium, osmium and iridium and 3–10%, by weight, of an active metal selected from the group consisting of Y, Hf and Zr onto the alloy and subsequently aluminizing the coated substrate.

5 Claims, 1 Drawing Figure

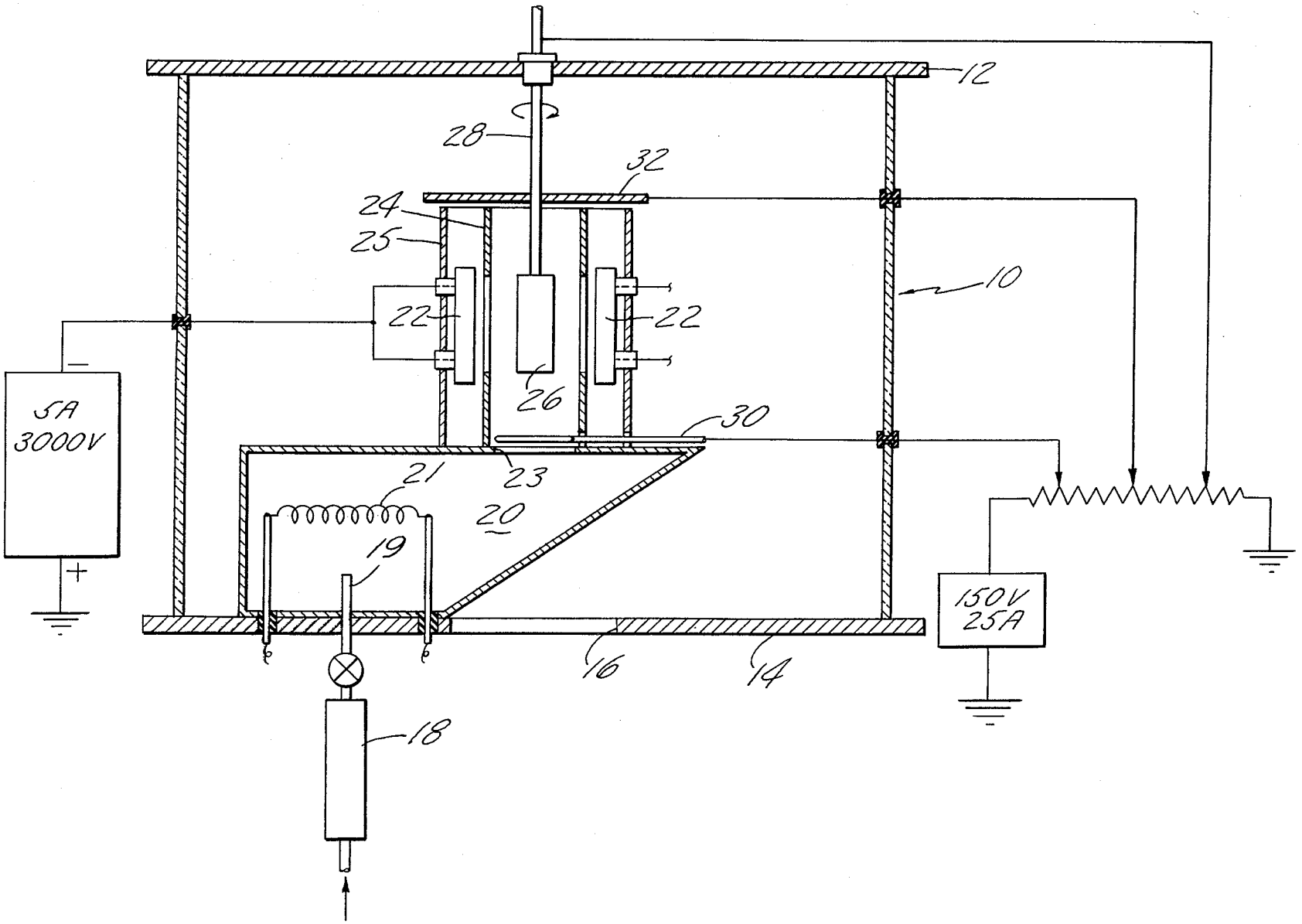
150V
25A
5A
3000V
10
12
14
16
18
19
20
21
22
23
24
25
26
28
30
32

METHOD OF FORMING ALUMINIDE COATINGS ON NICKEL-, COBALT-, AND IRON-BASE ALLOYS

BACKGROUND OF THE INVENTION

The present invention relates in general to oxidation- and corrosion-resistant coatings for metals and more particularly to a process for forming an aluminide coating on the nickel- and cobalt-base superalloys.

It is known in the art to improve oxidation resistance of the various nickel-, cobalt- or iron-base alloys used in gas turbine engine applications by providing them with aluminide coatings. Typical of the coating processes used are the pack coating methods described by Wachtell et al. U.S. Pat. No. 3,257,230 and Boone et al. U.S. Pat. No. 3,544,348 and the slurry method of Joseph U.S. Pat. No. 3,102,044. These processes are utilized to form, by reaction with one or more of the substrate elements along with simultaneous and/or subsequent diffusion heat treatment, one or more different aluminides which display good oxidation-erosion resistance and thus extend the operating lifetimes of the alloy components beyond those attainable in the uncoated condition.

It is also known, as described in the U.S. Pat. Nos. to Bungardt et al 3,677,789 and 3,692,554 to apply a separate layer of metal from the platinum group before the aluminum diffusion treatment in order to increase high temperature corrosion and scale resistance. As taught by Bundgardt et al, however, the expensive platinum layer must be at lest 3 microns, preferably 7 microns, thick.

SUMMARY OF THE INVENTION

It is an object of the present invention to improve oxidation resistance and sulfidation resistance of aluminide coatings and coated articles particularly in their application to the nickel-, cobalt-, or iron-base alloy gas turbine engine components while using minimal amounts of expensive platinum group metals.

The present invention contemplates the process for improving the characteristics of the aluminum-base protective coatings on the base alloy by (1) applying to the surface thereof a coating, to a thickness less than three microns, consisting essentially of (a) 90–97%, by weight, of a platinum group metal selected from the group consisting of platinum, palladium, rhodium, ruthenium, osmium and iridium and (b) 3–10%, by weight, of an active metal selected from the group consisting of yttrium, hafnium and zirconium and (2) aluminizing. For a platinum-yttrium preliminary coating, the preferred concentration is approximately 95–97%, by weight, platinum and 3–5%, by weight, of yttrium, the optimum concentration being 97% Pt, 3% Y.

In a preferred technique, the coating is applied by the sputtering of the platinum group metal and the active metal, either sequentially or simultaneously.

BRIEF DESCRIPTION OF THE DRAWING

An understanding of the invention will become more apparent to those skilled in the art by reference to the following detailed description when viewed in light of the accompanying drawing, wherein the FIGURE is a schematic of sputtering apparatus suitable for use in practicing the present invention.

DESCRIPTION OF THE PREFERRED EMBODIMENT

The present invention pertains to a method for improving the oxidation resistance and the corrosion resistance of aluminide alloys. In particular, a thin, platinum group metal-containing, preliminary combination coating is deposited onto the surface of a contemporary nickel-, cobalt- or iron-base alloy suitable for use in a gas turbine engine and then aluminized. The preliminary coating is less than three microns thick and consists essentially of a combination of 90–97%, by weight, of a platinum group metal selected from the group consisting of platinum, rhodium, ruthenium, osmium and iridium and 3–10%, by weight, of an active metal selected from the group consisting of yttrium, hafnium and zirconium.

The preliminary coating may be deposited by a variety of techniques with the platinum group metal and the active metal being applied either sequentially or simultaneously. If sequential, the combination coating will be in the form of a plurality of separate layers. In such case, although the layers may be deposited in any order, it is preferred that the platinum group metal be deposited last in order to protect the initial deposit of active metal (e.g., Y) from contamination or oxidation. This gives the ability to heat treat the coating separately from the deposition apparatus. Regardless of sequence, however, both components of the combination coating must be deposited before aluminization by the pack. It will be appreciated, of course, that if the heat treatment is done in situ (under protective atmosphere), it does not matter which component is deposited first. If simultaneous, e.g., co-sputtered, the combination coating will be either in the form of an intimate interspersion of one metal in the other, e.g., Y in the Pt, or in the form of an alloy of the two metals.

The combination coating may be deposited, for example, by plating from a liquid, dipping, flame spraying, reaction deposition, direct vapor deposition, hot spraying, cladding, slurry diffusion (provided that the active metal remains unoxidized in the deposited state), by sputtering or other vacuum deposition process which will provide protection from oxidation during deposition. A preferred technique for coating the layer on the superalloy structural member involves the co-sputtering of the pure platinum group element and the pure second metal element thereon while rotating the substrate.

It should be noted that while any of the aforementioned techniques may be utilized, a central concept for the skilled practitioner to bear in mind is that in order to reduce the amount of platinum used, the amount of dispersion of active metal within the platinum group metal is of primary importance. Thus, if separate layers of active metal and platinum group metal are contemplated, the greater the number of layers the better will be their intermixing — resulting in better inward diffusion and minimum compound formation.

Exemplary of conventional nickel-, cobalt- and iron-base alloys useful in gas turbine engines are those identified in the industry as follows:

| ALLOY DESIGNATION | NOMINAL COMPOSITION (Percent by Weight) |
|---|---|
| B-1900 | 8 Cr, 10 Co, 1 Ti, 6 Al, 6 Mo, .11 C, 4.3 Ta, |

-continued

| ALLOY DESIGNATION | NOMINAL COMPOSITION (Percent by Weight) |
|---|---|
| | .15 B, .07 Zr, balance Ni |
| MAR-M302 | 21.5 Cr, 10 W, 9 Ta, .85 C, .25 Zr, 1 Fe, balance Co |
| IN 100 | 10 Cr, 15 Co, 4.5 Ti, 5.5 Al, 3 Mo, .17 C, .75 V, .075 Zr, .015 B, balance Ni |
| MAR-M200 | 9 Cr, 10 Co, 2 Ti, 5 Al, 12.5 W, .15 C, 1 Nb, .05 Zr, .015 B, balance Ni |
| WI 52 | 21 Cr, 1.75 Fe, 11 W, 2(Nb + Ta), .45 C, balance Co |
| Udimet 700 | 15 Cr, 18.5 Co, 3.3 Ti, 4.3 Al, 5 Mo, .07 C, .03 B, balance Ni |
| MAR-M509 | 23.4 Cr, 10 Ni, 7 W, 3.5 Ta, .02 Ti, 0.5 Zr, balance Co |
| AMS 5616 | 13 Cr, 2 Ni, 3 W, .17 C, balance Fe |
| AMS 5504 | 12.5 Cr, balance Fe |

As indicated, the desired results may be obtained with a preliminary combination coating consisting essentially of, by weight, 90–97% platinum group metal and 3–10% active metal. For a platinum-yttrium preliminary coating, the preferred concentration range is about 95–97%, by weight, of platinum and 3–5%, by weight, of yttrium, the optimum concentration being 97% Pt, 3% Y.

It will be appreciated that the inventive process described herein requires a minimal amount of platinum to provide excellent oxidation resistance and particularly excellent sulfidation resistance. It is believed that this feature is attributable to the presence of the active metal, e.g., yttrium, which causes an increased adherence of the aluminum oxide formed during exposure to oxidative environments at high temperature. The coating thus provides superior protection for both oxidizing and sulfidation conditions of turbine engine operation with the least amount of expensive materials.

After deposition, the coated substrate is aluminized, that is, exposed to a source of aluminum with the aluminum being diffused inwardly to provide the highest concentration of platinum group metal and active metal at the external surface of the component. As those skilled in the art will recognize, aluminum may be deposited by any suitable technique such as by vapor deposition, flame or plasma spraying, electrophoresis, electroplating, slurry coating, pack cementation or the like, with the pack technique being preferred. Either during or after coating, or both, the part is diffusion heat treated to cause diffusion of the aluminum, the platinum group metal and the active metal into the surface of the substrate alloy.

As indicated, the preferred technique for depositing a preliminary coating of platinum group metal and second metal is by sputtering since the sputtering process readily lends itself to control of deposition rate and substrate temperature and simultaneously protects the active element from oxidation. A tetrode-type sputtering apparatus suitable for effecting deposition by condensation of vapor sputtered from separate targets is diagramed schematically in the drawing. A vacuum chamber 10 having a cover plate 12 and a base plate 14 is provided with suitable valves, pumps and insulated feedthroughs and is exhausted through a port 16 against a controlled argon leak admitted through gas purifier 18 and inlet 19 to maintain a dynamic pressure within the chamber of $1–10 \times 10^{-3}$ torr. Electrically heated thermionic emission means comprising a plurality of tungsten filaments 21 are located in a box 20 on the base plate 14 over the purified argon gas inlet. The box 20 is a complete enclosure except for the argon inlet 19 and an opening 23 in its upper wall. Located on the upper wall of the filament box 20 surrounding the opening 23 is a plasma box or enclosure 24 (preferably having tantalum walls) for containing the plasma generated in the box 20. A pair of opposed targets 22 are each positioned just outside openings in the inner tantalum walls of the enclosure 24 to eliminate sputtering to the back and the sides by the targets 22. Tantalum outer shielding walls 25 are also provided behind the targets. A substrate 26 to be coated is secured to a rotatable holder 28 such as a metal rod and is located between the targets 22 in the plasma box 24 over opening 23. A grid 30, in the form of a tantalum wire loop, to stabilize the generated plasma, is located below the substrate directly over the opening 23 while an anode 32 in the form of a flat metal plate spaced above and covering plasma box 24 is positioned above the substrate as shown in the drawing.

In operation, the tungsten filaments within the filament box 20 are heated to emit electrons and thus ionize the argon gas within the chamber. The ionized gas passes through opening 23 and fills the plasma box 24 around the substrate. The electrons are attracted to the substrate to aid in its heating and also to the anode to complete the electrical circuit. With a sufficient negative voltage, e.g., −10 to −5,000 V, preferably −100 to −2,000 V, imposed on the targets 22, the positive argon ions are attracted thereto to cause sputtering in the usual manner. It will be recognized that each target is separately connected to its own power source and may be sputtered simultaneously or sequentially onto the substrate. In either technique, appropriate control thereof is necessary to assure the proper proportional deposition of the platinum group metal and the active metal. In either event, rotation of the substrate is considered necessary, the speed of rotation being fast enough to avoid exaggerated grain growth and leader formation.

During the course of one investigation, a tetrodetype sputtering system of the type above-described was used in which the low energy electron bombardment of the substrate from the plasma discharge was used to maintain substrate temperature. The system was thoroughly outgassed in vacuum before deposition and the sputtering argon gas was purified by passage over hot (1,472°F) titanium chips. The platinum group metal sputtering target was typically a rolled sheet of platinum which formed a rectangle 1 ½ inches × 3 inches × ⅛ inch and had a tantalum backup plate. As will be appreciated, any other chemically stable support will serve to hold the platinum. The platinum analyzed at 99.9% purity. The second metal sputtering target, of yttrium, was of the same size and shape as the platinum and used a tantalum backup plate to hold an array of cast Y rods in a rectangular configuration. The yttrium analyzed at 99.9% purity with traces of Al, Ca, F, Fe and Mg present in amounts less than 0.03%, by weight.

A pin of B-1900 nickel-base alloy (nom. comp. 8 Cr, 10 Cr, 1 Ti, 6 Al, 6 Mo, .11 C, 4.3 Ta, 0.015 B, 0.08 Zr, balance Ni) approximately ¼ × 3 inches was polished to 600 grit on SiC paper and ultrasonically degreased with a mixture of trichloroethylene, acetone and benzene just prior to introduction into the sputtering unit. The substrate pin was secured to the holder 28 which permitted rotation of the specimen from the outside. The system was pumped down to $5 \times 10^{-6}$ torr with the electron emitter in operation, then Ti-gettered argon was bled into the system to $5 \times 10^{-3}$ torr. A discharge current of approximately 21 amperes was partitioned in a controlled way between the substrate (12 amps), the auxiliary anode (8 amps) and the grid (1 amp) to effect the plasma and heat the substrate.

After 15 minutes of electron bombardment to reach a substrate temperature of 1,050°C, sputtering was initiated by applying a 1,500 volt negative bias to the platinum target. Deposition on the rotating substrate was continued for approximately 48 minutes until a coating of 2.5 microns of platinum was achieved. A 500 volt negative bias was then applied to the yttrium target and deposition was run for approximately 26 minutes to achieve a coating of 0.3 microns yttrium. For flat surfaces, unrotated, the required deposition was 16 minutes for the Pt and 8 minutes for Y. After deposition, the system was shut down and the specimen was removed to a vacuum furnace where it was heat treated at 1,000°C for three hours. Next it was pack-aluminized according to the teachings of U.S. Pat. No. 3,544,348. In particular, the specimen was embedded in a pack mix containing 5–20 weight percent aluminum, 0.5–3% ammonium chloride, balance alumina. The pack was heated for 1 ½ hours at 1,400°F in an inert atmosphere (argon). Subsequently the article was subjected to a ductilizing heat treatment in argon at approximately 1,975°F for eight hours.

Cyclic sulfidation on the aluminized Pt + Y coated pin was run at 1,800°F (using a propane fired burner into which was injected a small amount of a solution of a soluble salt of sulfate, e.g., an aqueous solution of $Na_2SO_4$) for over 1,200 hours without coating failure which was equivalent to thicker coatings (approximately 10 $\mu$) formed on a second B-1900 substrate in the same way but without Y. An aluminide coating (approximately four mils) using the same pack and parameters on a third B-1900 substrate but without the intermediate platinum and yttrium coating, lasted only 150 hours in the identical test.

Other suitable specimens were prepared by the sputtering technique, one of which was produced by the co-sputtering of Pt and Y, and exhibited desirable intimate interspersion of the two elements in the coating.

It will be recognized by those skilled in the art that although a tetrode sputtering device was used in the presently described experimentation with means provided whereby electron current to the substrate was provided from the electron emitter, it would be suitable to sputter from a diode system having a resistance heater to provide radiation to the substrate sufficient to arrive at the temperature desired. It will be appreciated for example, that for flat plates or sheets, this may be accomplished by using a hot plate-type flat heater with Nichrome coils, or by hollow cathode electron beam devices which operate in the argon pressure regime required for the sputtering process. In the alternative, AC sputtering may be used in which two rods, one platinum and one yttrium, are activated by alternating current at 500 volts, each rod in series with a current controlling resistor so that sputter deposition in the proper ratio of Pt to Y is effected. As in the other technique, the required substrate temperature may be provided by any of the appropriate means, even resistance heating of the substrate itself.

What has been set forth above is intended primarily as exemplary to enable those skilled in the art and the practice of the invention and it should therefore be understood that, within the scope of the appended claims, the invention may be practiced in other ways than as specifically described.

We claim:

1. In a method of forming an oxidation- and sulfidation-resistant alloy coating on a nickel-base, cobalt-base or iron-base alloy gas turbine engine component wherein a platinum group metal is deposited on said alloy and then aluminized to diffuse both said aluminum and said platinum group metal into the surface thereof, the improvement which comprises, prior to aluminizing, depositing on said alloy a combination coating at least approximately one micron, but less than three microns thick, consisting essentially of 90–97%, by weight, platinum group metal selected from the group consisting of platinum, palladium, rhodium, ruthenium, osmium and iridium and 3–10%, by weight, of an active metal selected from the group consisting of yttrium, hafnium and zirconium.

2. The invention of claim 1 wherein said platinum group metal and said active metal are deposited sequentially to form a plurality of separate layers.

3. The invention of claim 1 wherein said platinum group metal and said active metal are deposited simultaneously to form an intimate interspersion of said active metal in said platinum group metal.

4. The invention of claim 3 wherein said active metal is yttrium and said platinum group metal is platinum, said metals being deposited simultaneously to form a combination coating consisting essentially of at least approximately one, but less than three microns of platinum having approximately 3–5%, by weight, yttrium intimately interspersed therethrough.

5. The invention of claim 4 wherein said yttrium is co-sputtered simultaneously with said platinum.

* * * * *